US012059595B2

(12) United States Patent
Booker-Bell

(10) Patent No.: US 12,059,595 B2
(45) Date of Patent: Aug. 13, 2024

(54) SQUAT EXERCISE SYSTEM

(71) Applicant: Colette Booker-Bell, Hampton, VA (US)

(72) Inventor: Colette Booker-Bell, Hampton, VA (US)

( * ) Notice: Subject to any disclaimer, the term of this patent is extended or adjusted under 35 U.S.C. 154(b) by 141 days.

(21) Appl. No.: 17/869,739

(22) Filed: Jul. 20, 2022

(65) Prior Publication Data

US 2023/0141420 A1 May 11, 2023

Related U.S. Application Data

(60) Provisional application No. 63/223,656, filed on Jul. 20, 2021.

(51) Int. Cl.
*A63B 24/00* (2006.01)
*A63B 21/00* (2006.01)
(Continued)

(52) U.S. Cl.
CPC ..... *A63B 24/0062* (2013.01); *A63B 21/4029* (2015.10); *A63B 2023/0411* (2013.01); *A63B 2024/0068* (2013.01); *A63B 2024/0071* (2013.01); *A63B 2071/0625* (2013.01); *A63B 2220/17* (2013.01); *A63B 2220/62* (2013.01); *A63B 2225/50* (2013.01)

(58) Field of Classification Search
CPC ..... A63B 24/0062; A63B 21/4029; A63B 2023/0411; A63B 2024/0068; A63B 2024/0071; A63B 2071/0625; A63B 2220/17; A63B 2220/62; A63B 2225/50; A63B 2220/20; A63B 2225/20; A63B 2220/833; A63B 2225/74; A63B 23/0405; A63B 71/0622
See application file for complete search history.

(56) References Cited

U.S. PATENT DOCUMENTS 6,358,188 B1 * 3/2002 Ben-Yehuda ..... A63B 24/00 482/92
6,685,480 B2 * 2/2004 Nishimoto ..... G09B 15/00 482/8
(Continued)

FOREIGN PATENT DOCUMENTS

GB 2408097 A * 5/2005 ..... A63B 21/0783

*Primary Examiner* — Andrew S Lo
(74) *Attorney, Agent, or Firm* — Deidre McAuley

(57) ABSTRACT

Provided is a squat exercise system and a method for tracking squats performed that includes a bench component which functions as a landing for a user and a remote control system that controls operations performed by the squat exercise system and includes a remote control unit operating the squat exercise system, and a housing removably attached to an underside of the bench component that includes a power supply unit supplying power, a sensing device which senses a body part of the user when within a predetermined distance from the bench component and generates a signal, a processor/control unit that receives and processes the signal by the sensing device in communication therewith, and automatically tracks, in real-time a count of each successful squat completed and a total count thereof, and a notification unit in communication with the processing/control unit that generates a notification signal indicative of successful completion of a squat.

20 Claims, 8 Drawing Sheets

(51) Int. Cl.
*A63B 23/04* (2006.01)
*A63B 71/06* (2006.01)

(56) References Cited

U.S. PATENT DOCUMENTS

| | | | | |
|---|---|---|---|---|
| 7,455,621 | B1 * | 11/2008 | Anthony | A63B 24/0062 482/3 |
| 7,666,118 | B1 * | 2/2010 | Anthony | A63B 21/0724 482/8 |
| 2005/0233871 | A1 * | 10/2005 | Anders | A63B 21/078 482/8 |
| 2016/0346617 | A1 * | 12/2016 | Srugo | G16H 40/67 |
| 2017/0100630 | A1 * | 4/2017 | Mizuno | A63B 23/12 |
| 2017/0165522 | A1 * | 6/2017 | James | A63B 71/0686 |
| 2018/0125395 | A1 * | 5/2018 | Myer | A61B 5/1127 |
| 2019/0143176 | A1 * | 5/2019 | Wilson | A63B 69/0059 434/247 |
| 2019/0232148 | A1 * | 8/2019 | Franklin | A63B 71/0622 |
| 2021/0001172 | A1 * | 1/2021 | Namboodiri | G16H 20/30 |
| 2021/0008413 | A1 * | 1/2021 | Asikainen | G06F 3/0304 |
| 2022/0176200 | A1 * | 6/2022 | Jiang | A63B 24/0021 |
| 2022/0203168 | A1 * | 6/2022 | Calderon | A63B 24/0062 |
| 2023/0285805 | A1 * | 9/2023 | Tsotsos | A61B 5/1121 |
| 2023/0285806 | A1 * | 9/2023 | Webster | G06T 7/20 |

* cited by examiner

SQUAT EXERCISE SYSTEM

CROSS-REFERENCE TO RELATED APPLICATIONS ORIGIN OF INVENTION

The present invention claims priority to the Provisional Application Ser. No. 63/223,656 filed on Jul. 20, 2021, the contents of which are incorporated herein in its entirety.

I. TECHNICAL FIELD

The present invention relates generally to an exercise system. In particular, the present invention relates to a squat exercise system and a method to automatically track, in real-time, the accuracy of performance, and a count of each squat exercise successfully completed by a user.

II. BACKGROUND

Exercise equipment and systems have been known to help promote good health by improving physical appearance, digestion and strength. A squat is performed to activate and engage several parts of the body including for example, glutes, quads, hamstrings and core muscles of a person.

There is a particular technique required in order to perform a successful squat including keeping the head up, the torso straight and engaging the core as the person squats sending the hips in a backward and downward direction, simultaneously.

Several issues may occur when a person performs a squat incorrectly including for example, possible injury.

It is therefore desirable to provide a squat exercise system capable of assisting a user in successfully performing squat exercises while automatically tracking in real-time the accuracy of performance and a total count thereof.

III. SUMMARY OF THE EMBODIMENTS

Embodiments of the present invention provide a squat exercise system including a bench component which functions as a landing for a user and a remote control system that controls operations performed by the squat exercise system and includes a remote control unit operating the squat exercise system, and a housing removably attached to an underside of the bench component that includes a power supply unit supplying power, a sensing device which senses a body part of the user when within a predetermined distance from the bench component and generates a signal, a processor/control unit that receives and processes the signal by the sensing device in communication therewith, and automatically tracks, in real-time a count of each successful squat completed and a total count thereof, and a notification unit in communication with the processing/control unit that generates a notification signal indicative of successful completion of a squat.

Additional embodiments include a method of performing squat exercises via the above-mentioned system.

The foregoing has broadly outlined some of the aspects and features of various embodiments, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

IV. DESCRIPTION OF THE DRAWINGS

Figure 1A:
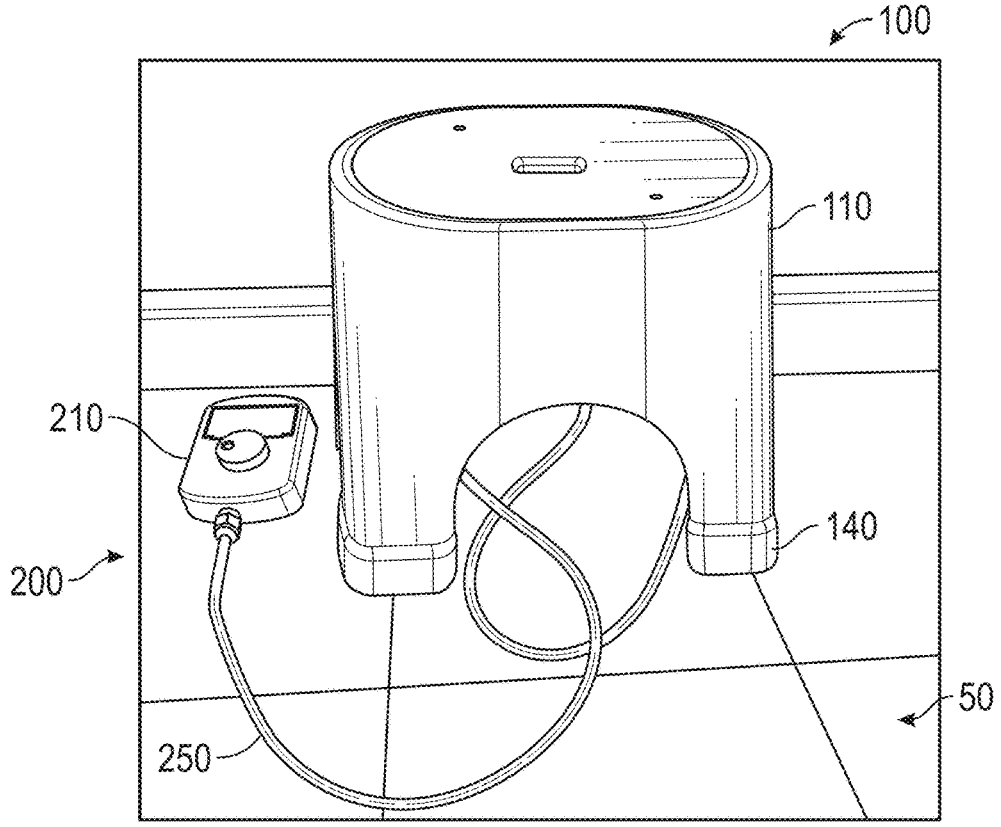
FIGS. 1A and 1B are photographs illustrating a squat exercise system including a remote control system in an on and off state respectively, that can be implemented in accordance with one or more embodiments of the present invention.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

V. DETAILED DESCRIPTION OF THE EMBODIMENTS

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components.

In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

As noted above, the embodiments provide a squat exercise system for assisting users in accurately performing squat exercises and automatically tracking, in real-time a count of completion thereof.

Embodiments of the present invention, provide a squat exercise system that enables users to perform squats low enough to ensure that they have completed a successful squat that will render guaranteed results.

Figure 1B:
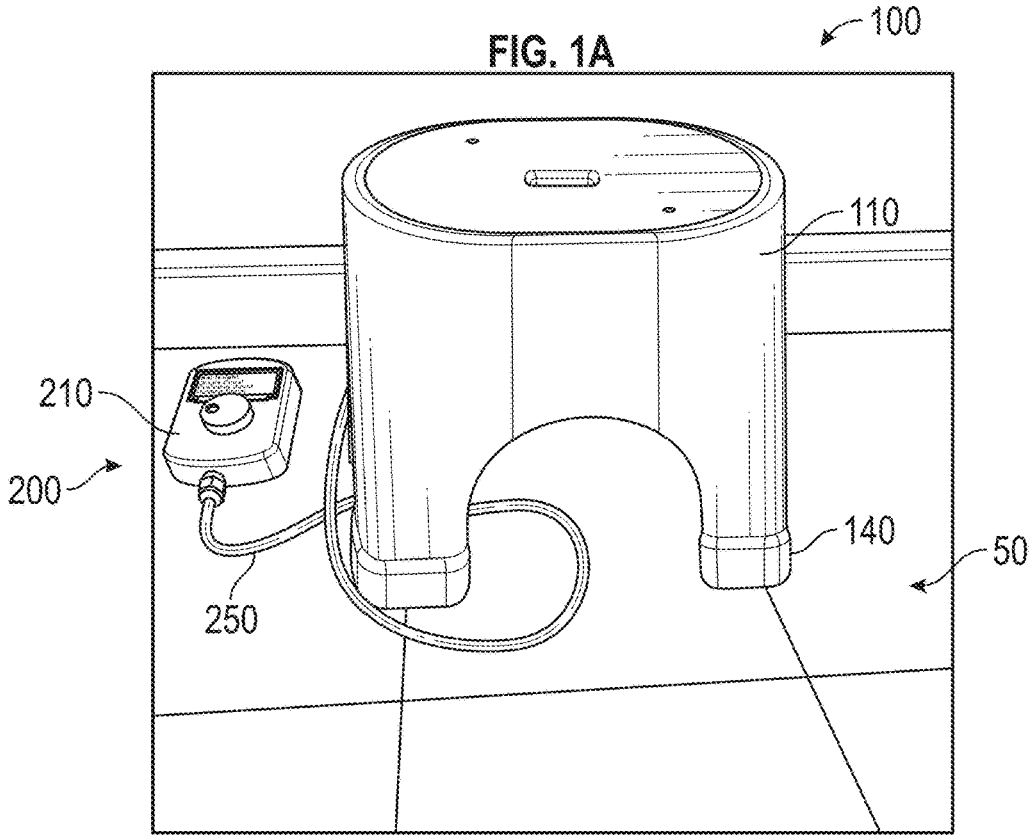
Figure 3A:
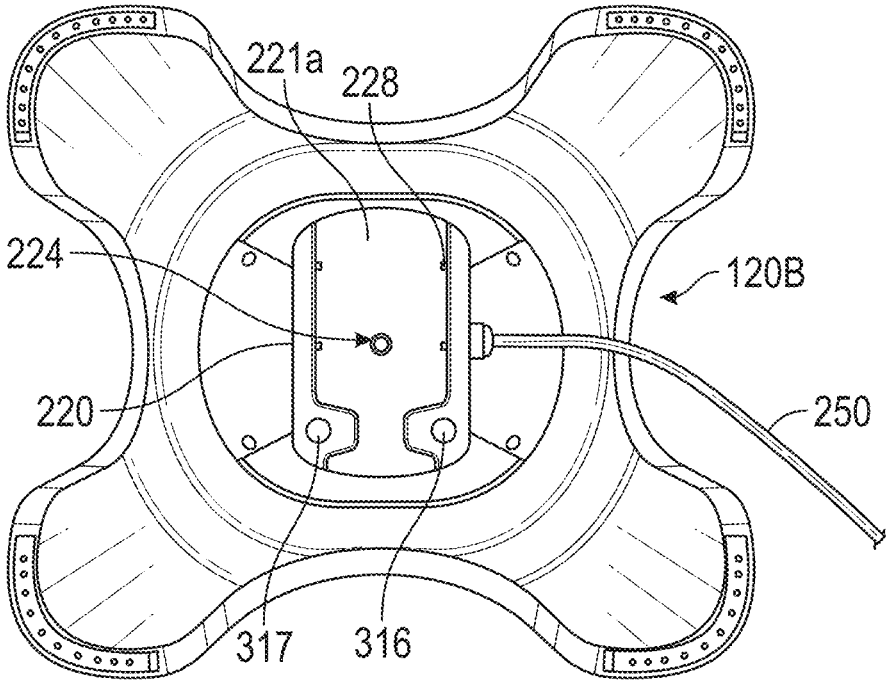
FIGS. 3A and 3B are photographs illustrating the bottom view of the squat exercise system shown in FIG. 1 including the remote control housing and the remote control housed therein respectively, according to one or more embodiments of the present invention.
Figure 3B:
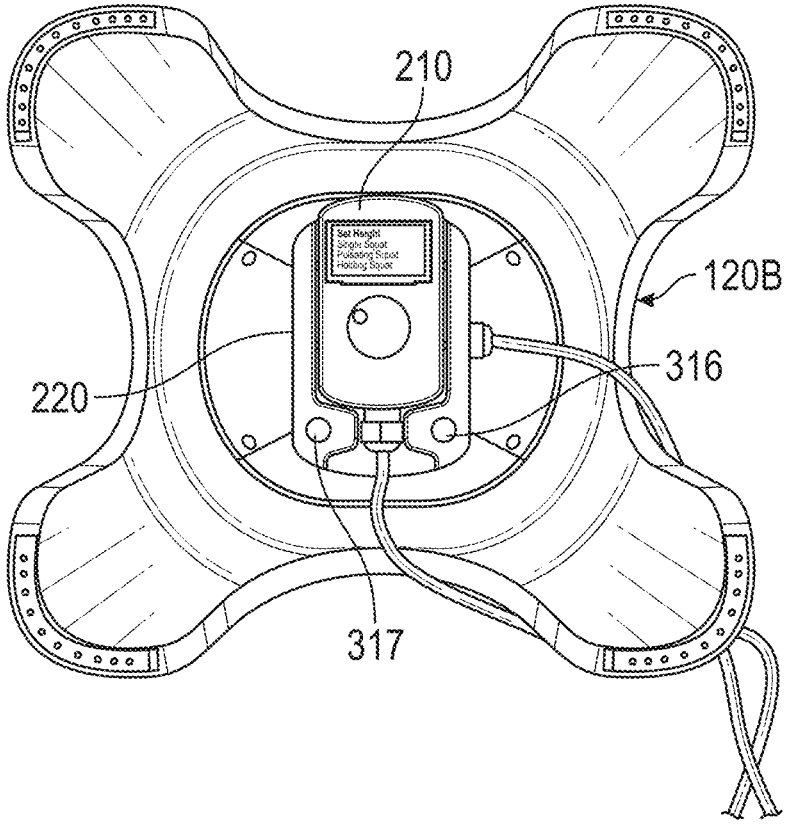

FIGS. 1A and 1B illustrate, a squat exercise system 100 in an on-state and an off-state, respectively. The squat exercise system 100 includes a bench component 110 acting as a landing or seat for a user, and a remote control system 200 including a remote control unit 210 for operating the squat exercise system 100 and a housing 220 removably attached to an underside 120*b* of the bench component 110 (as depicted in FIGS. 3A and 3B) which houses the operating components 300 of the remote control system 200 of the squat exercise system 100 therein (to be discussed below with reference to FIGS. 7 and 8).

Figure 7:
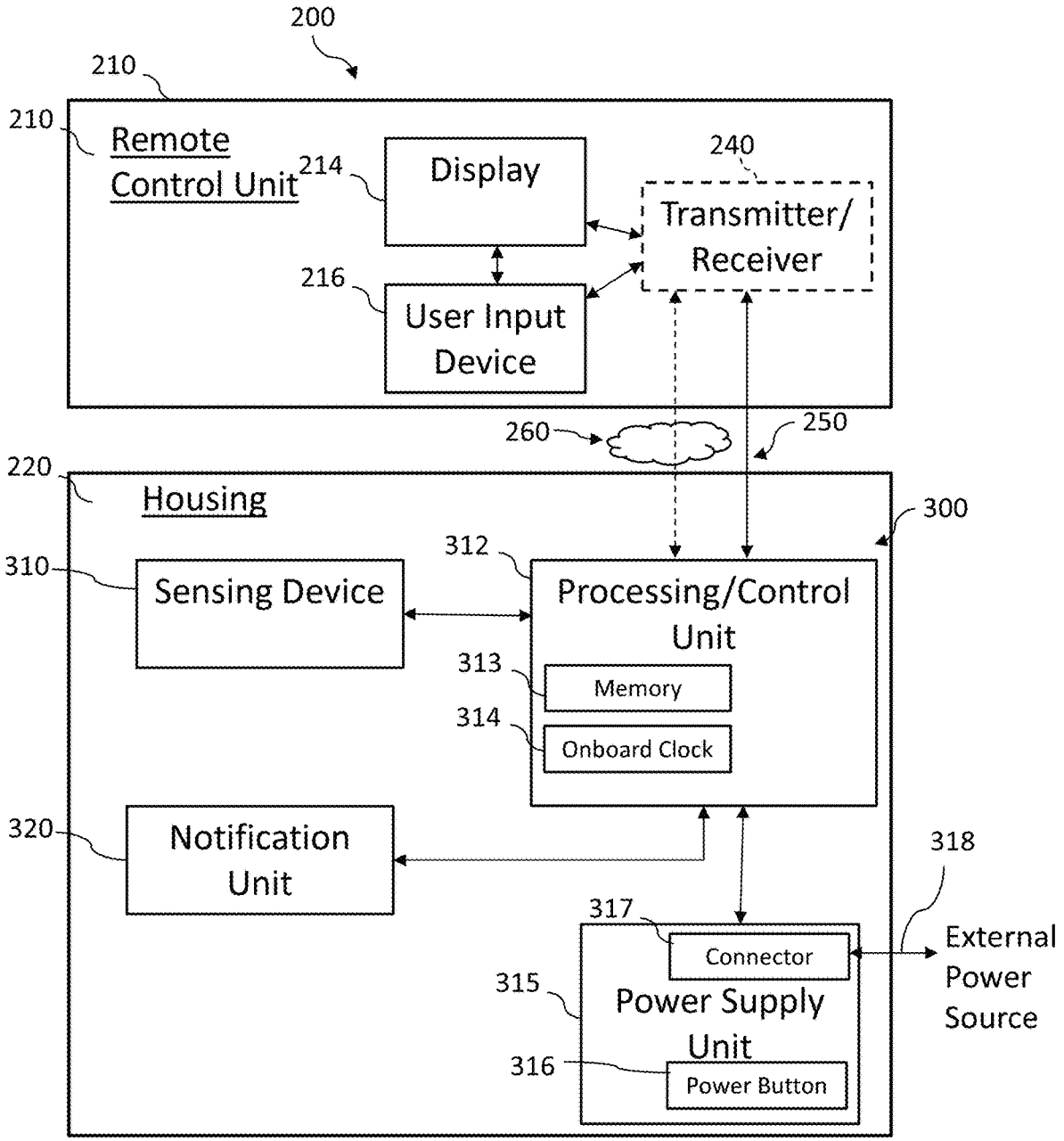
FIG. 7 is a block diagram illustrating the components housed within the remote control housing unit, according to one or more embodiments of the present invention.

In the current embodiment, the remote control unit 210 and the operating components 300 in the housing 220 (which is attached to the bench component 110) of the remote control system 200 are communicatively coupled together via a wiring (enclosed in a cable gland) 250. Additionally, electrical connectors can be included within the housing 220 to connect/disconnect the wiring 250 between the remote control unit 210 and the housing 220. According to other embodiments, the remote control unit 210 may communicate with the operating components 300 wirelessly over a communication network 260 (as depicted in FIG. 7).

Figure 2:
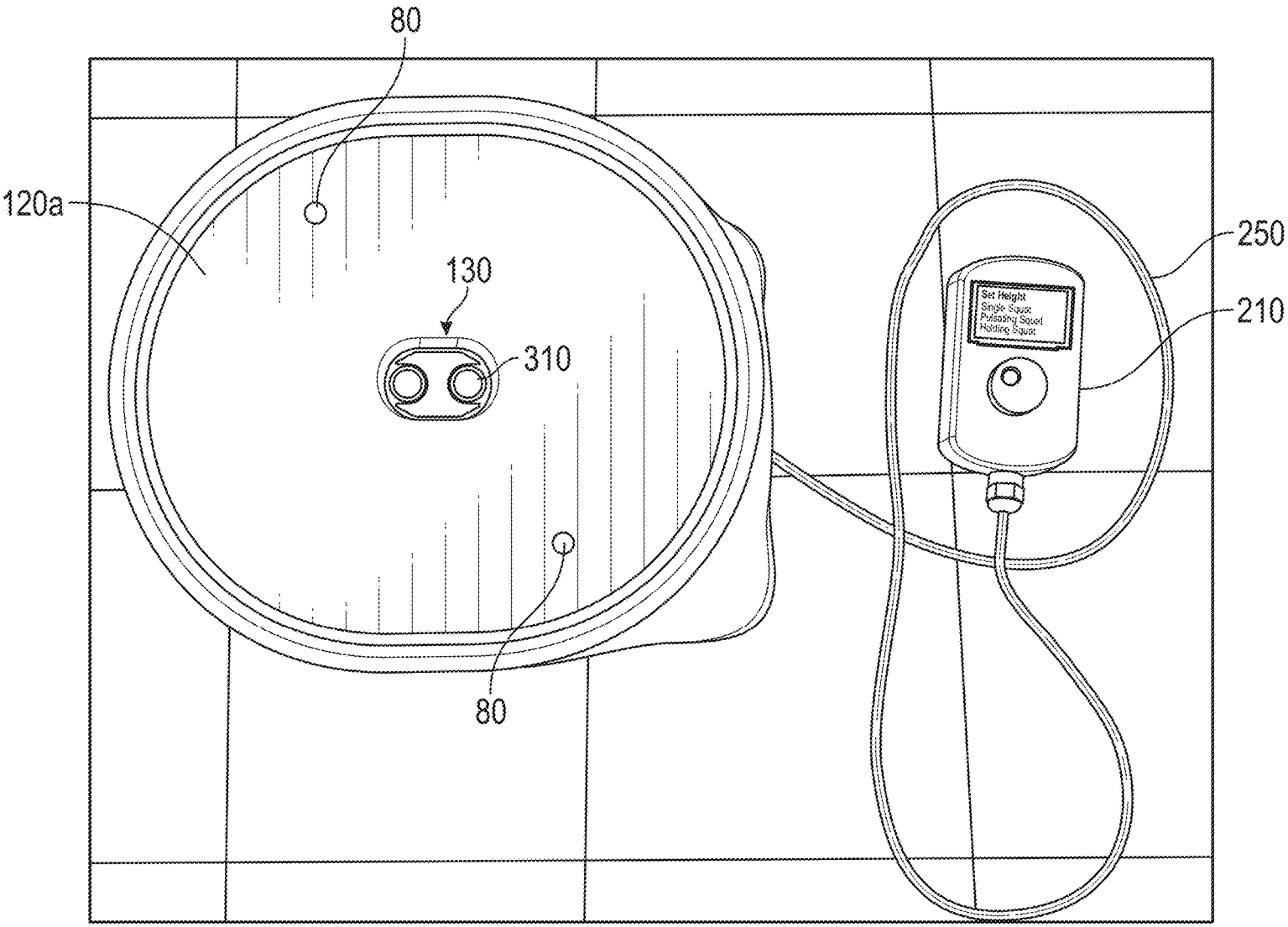
FIG. 2 is a photograph illustrating a top view of the bench component and the remote control unit of the squat exercise system shown in FIG. 1, according to one or more embodiments of the present invention.
Figure 8:
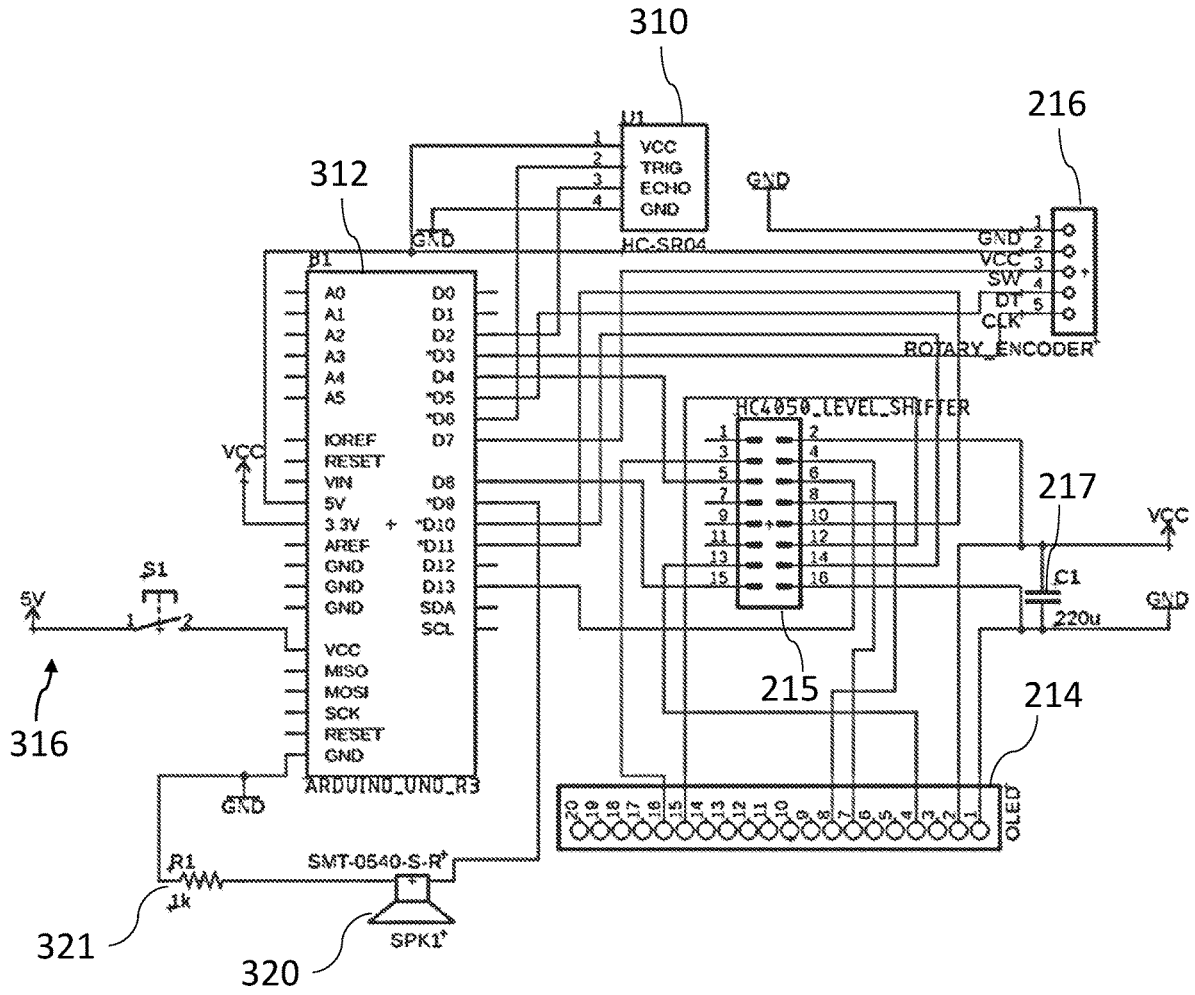
FIG. 8 is an electrical circuit illustrating the electrically communicative coupling between the components shown in FIG. 7, according to one or more embodiments of the present invention.

As shown in FIG. 2, the bench component 110 includes an opening 130 at a top portion 120*a* thereof for displaying a sensing device 310 (e.g., an ultrasonic range sensor(s)) of the remote control system 200 (as depicted in FIG. 8; discussed below) along with multiple leg portions 140 for standing in an upright position on a flat surface 50 (e.g., a floor). The bench component 110 may also include collapsible, adjustable handrails (not shown) and the leg portions 140 may also be adjustable to adjust the height of the bench component 110, to further assist a user in successfully performing squat exercises in accordance with other embodiments of the present invention. The bench component 110 is not limited to any particular size and/or shape and therefore may vary. Also, the bench component 110 may be formed of any material suitable for the purpose set forth herein.

Figure 4:
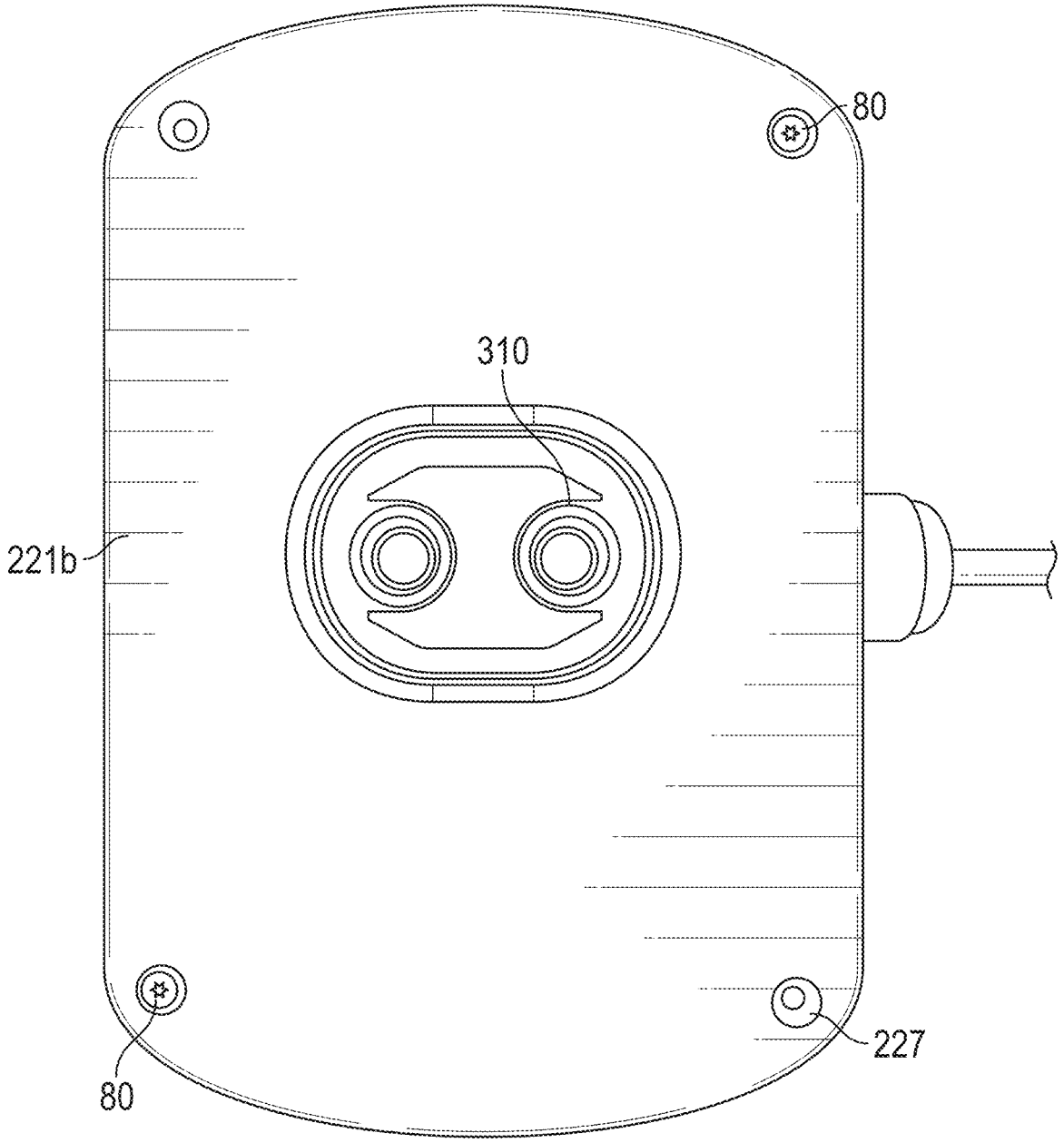
FIG. 4 is a photograph illustrating a bottom view of the remote control housing shown in FIGS. 3A and 3B to be removably attached to the underside of the bench component, according to one or more embodiments of the present invention.
Figure 5A:
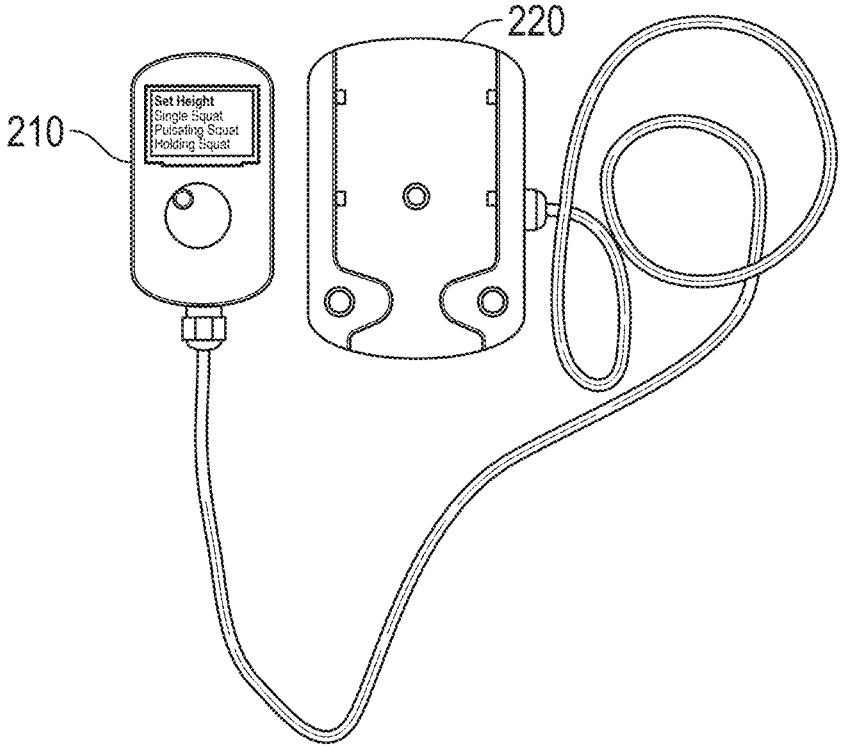
FIGS. 5A and 5B are photographs illustrating the remote control system of the squat exercise system including the remote control unit and the remote control housing, according to one or more embodiments of the present invention.
Figure 5B:
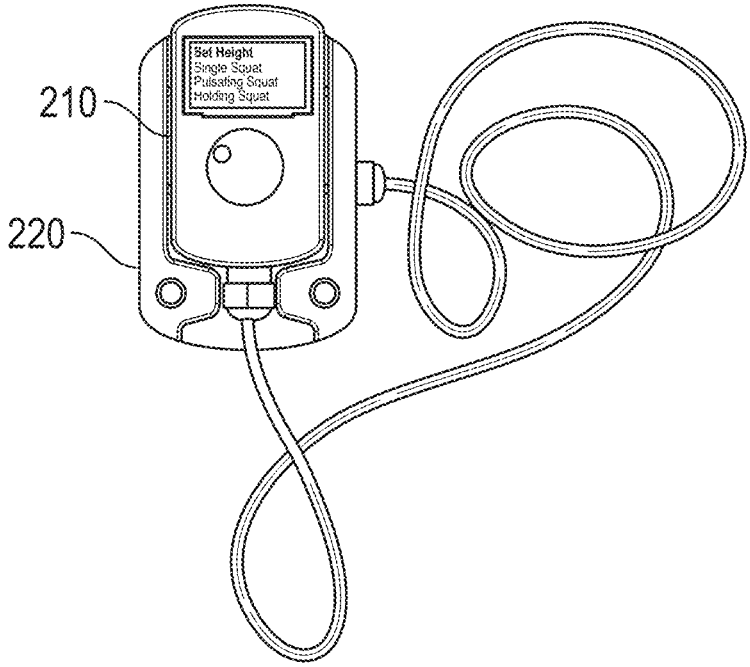

As further shown in FIG. 2 through 4, the housing 220 of the remote control system 200 is removably attached to the underside 120*b* of the bench component 110 via an attaching means 80 (e.g., screws). The present invention is not limited hereto and any suitable attaching means may be used. Since the housing 220 is removably attached to the bench component 110 as shown in FIGS. 5A and 5B, the squat exercise system 100 including the remote control system 200 can operate without the bench component 110 in accordance with alternative embodiments of the invention. As shown in FIGS. 5A and 5B, the remote control unit 210 is removably attached to the housing 220 and therefore can operate separate and apart from the bench component 110. For example, in alternative embodiments, the housing 220 can be positioned directly on the flat surface 50 with the sensing device 310 facing an upright and a user can perform squat exercises in the direction of the sensing device 310, as shown in FIG. 4.

Figure 6A:
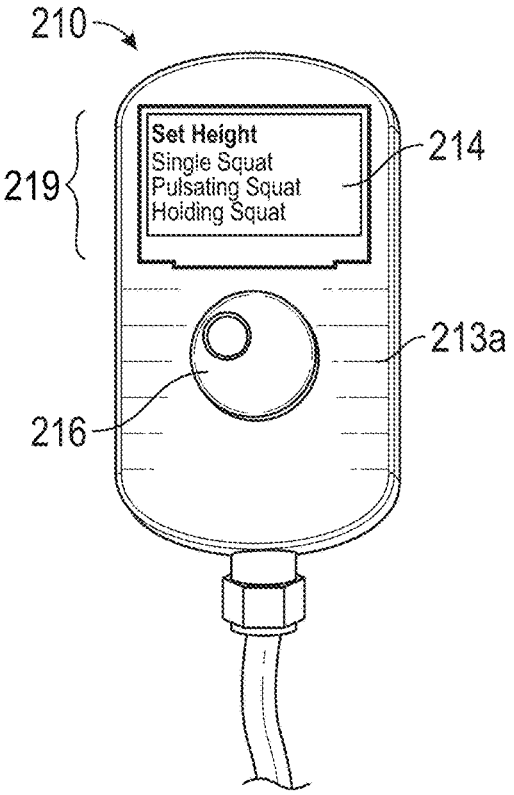
FIGS. 6A and 6B are photographs illustrating a front view and back view of the remote control unit of the remote control system, according to one or more embodiments of the present invention.
Figure 6B:
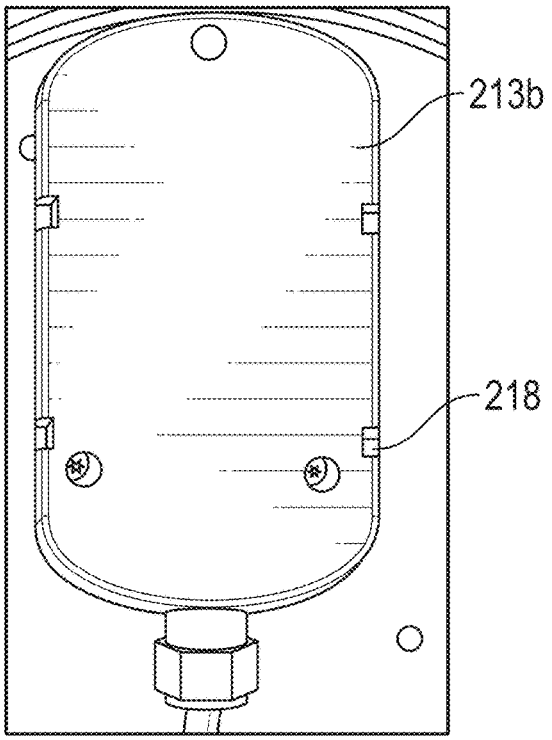

The outer body 221 of the housing 220 is formed of a hard plastic material such as an acrylonitrile butadiene styrene (ABS) plastic formed by fused deposition modeling (FDM), for example, or any other suitable material for the purpose set forth herein. The outer body 221 includes a speaker output 224 which includes a plurality of holes for outputting audio signals to indicate squat status information and a power button 316 for initiating an on-off state of the remote control unit system 200, a connector 317 for receiving a recharging cord 318 (as depicted in FIG. 7) to recharge the system 200 and openings 227 as depicted in FIG. 4, for receiving the attaching means 80 to secure the housing 220 to the underside of the bench component 110. The outer body 221 further includes a plurality of protruding portions (e.g., male connectors) 228 spaced apart along a surface thereof for receiving and removably storing the remote control unit 210 therein when not in use, as shown in FIG. 3B. As shown, the remote control unit 210 will remain in place until the user manually releases the remote control unit 210 from the housing 220 by releasing the protruding portions 228 of the housing 220 from the openings (i.e., female connectors 218 as depicted in FIG. 6B) of the remote control unit 210. According to one embodiment, the remote control unit 210 is slid from the housing 220. Alternatively, the outer body 221 of the housing 220 may connect to the remote control unit 210 using any suitable connecting or holding means or the remote control unit 210 may be separately stored elsewhere within a bench component 110 or in a remote external location.

Details regarding the remote control unit 210 will now be discussed with reference to FIGS. 6A and 6B. As shown in FIGS. 6A and 6B, the remote control unit 210 is a hand-held device formed of a different or similar hard material as that of the housing 220. Alternatively, the remote control unit 210 may be a wearable device or the operations thereof may be implemented as a software via an external device (e.g., a mobile device). In the current embodiment, the remote control unit 210 includes a front surface 213*a* and a back surface 213*b*. The front surface 213*a* includes a display 214 and a user input device 216 for receiving user instructions thereon. The display 214 is configured to display various squat exercise information 219 including but not limited to squat height information for the user for performing the squat, squat status and type of squat exercise to be perform (e.g., single, pulsating or holding squat), squat count and associated timing information (completed time, pause, resume), and optionally a visual warning information. The present invention is not limited to any particular information being displayed on the display 214 and can vary accordingly. According to one embodiment, the user input device 216 is a rotary device allowing the user to toggle between the squat exercise information 219 and select options type of squat to be performed and preset settings (e.g., squat height) as desired to initiate performance of a squat exercise. As the user selects the options and preset setting of choice, selection is highlighted as shown and the user may then push the user input device 216 inward to make the selection of the highlighted option or information. The user input device 216 is not limited to a rotary input device and can be a keyboard or button or other suitable input device for the purposes set forth herein according to other embodiments of the present invention. The remote control unit 210 further includes a transmitter/receiver 240 (as depicted in FIG. 7) for transmitting/receiving data between the remote control unit 210 the operating components 300 within the housing 220. Additional details regarding operation of the remote control system 200 will be discussed below with reference to FIGS. 7 and 8.

Referring back to FIG. 6B, as mentioned above, the back surface 213*b* of the remote control unit 210 includes receiving portions 218 for receiving the protruding portions 228 of the housing 220, when storing thereon.

FIGS. 7 and 8 illustrate the remote control system 200 including the remote control unit 210 and the housing 220 and the operation thereof.

As shown in FIG. 7, the remote control unit 210 includes the display 214, the user input device 216 and the optional transmitter/receiver 240. The housing 220 includes several operating components 300 of the remote control system 200 including the sensing device 310 including one or more sensors, a processor/control unit 312, the power supply unit 315, and a notification unit 320. A detailed description the above components is described below with reference to FIGS. 7 and 8.

According to an embodiment, the display 214 of the remote control unit 210 is a graphic display module (e.g., an OLED graphic display module) for displaying a scrollable menu including selection options along with squat information and settings to the user. The display 214 is connected to a level shifter 215 and a capacitor 217 for translate signals from one voltage or logic level to another to enable compatibility between within the circuitry shown in FIG. 8.

As previously mentioned above, the user input device 216 is a rotary-type input device with push button and can be used as a rotatable push knob for navigating and selection options 219 on the display 214 of the remote control unit 210. A separate transmitter/receiver 240 may also be included for transmitting/receiving instructions from the processor/control unit 312. The components of the remote control unit 200 are mounted to a PCB or breadboard for safe holding therein.

According to some embodiments, the remote control system 200 or the features thereof accessible via a wearable device (as mentioned above) can be voice-activated, such that users can speak commands to operate the squat exercise system 100, for example, to turn on and off the system 100 and make the squat exercise selections via voice technology.

According to some embodiments, the sensing device 310 includes an ultrasonic distance sensor module that measures the distance from the bench component 110 to the user's body when performing squat exercises. The sensing device 310 may include one or more sensors and the type of sensing device is not limited hereto, for example, a motion sensing device, heat sensing device or other sensing device suitable for the purposes set forth herein may be used. Optionally, the sensing device 310 may be disposed within the bench component 110 instead of the housing 220, for example, in a center region on the top outer surface of the bench component 110 according to one or more embodiments of the present invention. The sensing device 310 is not limited hereto and can be disposed in any other suitable location for the purpose set forth herein. For example, the sensing device 310 can be positioned adjacent to a front region of the top portion 120*a* thereof (depicted in FIG. 2).

Further shown in FIGS. 7 and 8, operating components 300 housed in the housing 220 will now be described. The sensing device 310 senses a body part of a user (e.g., the user's rear end) when within a predetermined distance away (e.g., approximately 1 to 3 inches) from the top of the bench component 110 and generates an associated audio signal.

The processor/control unit 312 comprises at least one microprocessor, microcontroller, central processor (CPU) or other control unit and is in communication with the sensing device 310 and receives, processes data signals generated therefrom and data received and transmitted to and from the remote control unit 210. The processor/control unit 312 resides on a printed circuit board (PCB) having the operating components 300 and various wires as shown in FIGS. 7 and 8 connected thereto for operation of the remote control unit 200. The processor/control unit 312 is capable of sending instructions to and from the other operating components 300 for example, the sensing device 310, the notification unit 320, the power supply unit 315; and the remote control unit 210 or any external devices. The processor/control unit 312 further includes a memory 313 for storing software instructions to receive the sensor information from the sensing device 310 and stores it therein and transmits data signals to the display 214. Alternatively, a memory can also be included within the remote control unit 210 for storing the data input by the user at the user input device and transmitting the data to the processor/control unit 312.

The processor/control unit 312 further includes an onboard clock 314 (e.g., timer/counter) to count and track the time difference between the current time and an exercise start time (as discussed below) to determine the duration of the squat exercise being perform for displaying to the user via the display 214. The processor/control unit 312 automatically tracks, in real-time, an accurate count of completion of each successful squat exercise performed by user and provides a total count to the user via the display 214. Alternatively, the components of the processor/control unit 312 may be separate components (e.g., a separate processor/controller, memory, timer and digital counter) electrically connected together for operation according to other embodiments.

In yet another embodiment, the output from the processor/control unit 312 can be pushed via a webhook on a communication network such as Wi-Fi or Bluetooth capabilities to an external device (e.g., a wearable device) or other external device instead of the remote control unit 210 suitable for the purpose set forth herein.

As shown, the power supply unit 315 is configured to supply power to the remote control system 200 and may include one or more replaceable or rechargeable battery pack. According to one embodiment, the battery pack may be a 12V rechargeable battery pack and include one or more lithium-type batteries along with a protection board for safely recharging the batteries. The present invention is not limited to any particular type of power supply and may vary as needed. For example, the power supply unit 315 can receive power from an external power source or by an optional USB charging device, for example. The on-off state of the remote control system 200 is initiated by use of a power button 316 which may be a push button-type device, for example, a 12 volt (V) light emitting diode (LED) latching power button to turn the remote control system 200 on and off. The power supply unit 315 further includes a connector 317 (e.g., a female barrel connector) for receiving a recharging cord 318 to be inserted therein in and connecting to an external power source for recharging purposes. The recharging cord may be for example, a 12 volt (V) 3 amp (A) charging cord with a male connector for connection to the connector 317 of the power supply unit 315.

The notification unit 320 is also included and is in communication with the processor/control unit 312 for receiving a signal therefrom, processing the signal received and providing a notification signal to a user upon performing a squat or other operations of the squat exercise system 100, for example, setting height or receiving a warning signal (discussed in more detail below). The notification unit 320 can be an audio and/or visual generating signal unit for example, a speaker and a transmitter (e.g., a microphone) or buzzer generating an audio signal (e.g., a beep), and/or optionally a lighting device (e.g., an LED) generating a light (e.g., green in color) indicative of a successful squat being completed, or any type of signaling unit or components capable of generating a notification signal as set forth herein.

A resistor 321 e.g., of 1 kΩ, for example, is used to connect the notification unit 320 (e.g., a buzzer) to ground (as depicted in FIG. 8).

According to some embodiments, when a user is performing the squat, the notification unit 320 may generate one or more series of beeps to indicate to the user has completed a successful squat and generates a different sound or beep when a successful squat has not been completed. The present invention is not limited to any particular number of beeps or holding time.

According to other embodiments, a wearable device is provided to enable a user to receive a notification signal thereon from the notification unit 320. The notification signal received can cause a vibration to occur at the wearable device. The wearable device can be a bracelet for example, which receives the notification signal and vibrates to indicate that a squat has been performed accurately. This feature is a benefit for those who have hearing disabilities or when users opt to eliminate audio signals from the system. The system 200 can be implemented with and synced with other external devices, for example, other exercise tracking devices such as a FitBit® to enable users to sync and keep track of their progress externally from the system. This implementation can also enable a user to create squat goals in advance via the external device and implement those goals via the squat exercise system and possible participate in challenges with other users of other squat exercise systems. This implementation can also be included in the wearable device of the system according to other embodiments. The vibration feature can be performed using Bluetooth technology or other suitable technology. The bench component 110 is paired up with a wearable device during a pairing operation such that upon receiving a signal from the sensing device 310, the processor/control unit 312 will generate and transmit a signal to the wearable device (e.g., the bracelet) to vibrate once a successful squat is completed.

As mentioned, several operating components 300 of the squat exercise system are housed within the housing 220. However, the present invention is not limited hereto. Alternatively, some of these components operating 300 may be housed within the remote control unit 210 itself or in an external device in communication with the remote control system 200. For example, the processing unit 312 and notification unit 320 may be in the remote control unit 210. Alternatively, the remote control unit 210 may include a separate processing unit (not shown) to be in communication with the processor/control unit 312 of the housing 220. According to embodiments of the present invention, the squat exercise system can perform various methods wherein squats can be performed or squat settings can be preset by the user at the remote control unit 210 as follows:

Single Squat/Jump Squat Setting:

1. User selects "Set Height" on the display 214 via the user input device 216, to preset height to squat based on the user's height into the squat or how deep of a squat the user wants to do. Specifically, the user gets into a desired squat position and then pushes the input user device 216 to set the squat height. The system 200 automatically saves the squat height at the memory 313 of the processor/control unit 312. The system 200 will automatically set the height to approximately 5-6 inches if the user does not preset a height.
2. User then selects the "Single Squat" via the user input device 216 to set the system 200 to the single squat setting.
3. User squats over the bench component.
4. The sensing device is activated once user's body part (rear end) is located at the preset height from the sensing device 310 located on the bench component
5. The sensing device sends a signal to a processor/control unit 312 or directly to the notification unit 320.
6. The notification unit generates a sound (e.g., a single or series of beeps) alerting the user that he/she is in the predetermined range and has completed a successful squat and the onboard clock 314 of the processor/control unit counts the squat as completed.
7. The number of the squat is displayed on the display 214.
8. The user rises from squat and repeats.
9. According to another embodiment, if the user chooses to do timed squats, the onboard clock 314 tracks how many squats the user performs in a predetermined time, as set by the user.
10. Completed time and number of completed squats will remain displayed for a predetermined period of time at the display 214

If at any time the user decides to pause the system 200, the user can go back to the menu at the input user device 216 and click to pause, check time and/or number of squats completed, then select resume to resume at the original time upon pausing, as well as at the number of squats already completed or select end to terminate that exercises and move on to a different type of squat exercise by returning to the menu.

Pulsating Squats Setting:

1. User selects "Set Height" on the display 214 via the user input device 216, to preset height to squat based on the user's height into the squat (similar step as that of the single squat).
2. User then sets the system 200 to the pulsating squat setting via the menu at the user input device 216.
3. User then presets the number of pulses planned for each squat. (For purposes of example only, three pulses per squat will be used). The present invention is not limited hereto and can vary, as necessary.
4. User squats up and down just within the preset height over the bench component 110.
5. The sensing device 310 is activated once user's body part (i.e., rear end) is located at a predetermined distance away from the sensing device 310 at the bench component 110.
6. The sensing device 310 sends a signal to processor/control unit 312 and/or directly to the notification unit 320.
7. The notification unit 320 generates a beep alerting the user that he/she is in the predetermined range for a successful squat.
8. The user performs three squat pulses while remaining in the predetermined range.
9. Unlike the single squat, here the notification unit will sound at each pulse, once the user completes a round of three pulses within the squat after the third (or last) pulse, the notification unit generates a different sound or beep to notify the user that they have successfully completed a pulsating squat and also the processor/control unit 312 counts the pulsating squats and sends a data signal to the display 214 to display the number of the pulsating squats to the user.

10. The user rises from squat and repeats until the total number of pulsating squats is completed as desired.
11. According to another embodiment, if the user chooses to do timed pulsating squats, the onboard clock 314 tracks how many pulsating squats the user performs in a predetermined time, as set by the user.
12. The completed time and number of completed pulsating squats will remain displayed at the display 214 for a predetermined amount of time.

Holding Squat Setting:

1. User selects "Set Height" on the display 214 via the user input device 216, to preset the height to squat based on the user's height into the squat.
2. User sets the system 200 to the holding squat setting via the user input device 216 and selects the amount of time the user wishes to hold squat. (For purposes of example only, 30 seconds will be used).
3. User squats over the bench component 110.
4. The sensing device 310 is activated once user's body part (rear end) is located at a predetermined distance from the sensing device 310 at the bench component 110.
5. The sensing device 310 then sends a signal to a processor/control unit 312 and/or directly to the notification unit 320.
6. The notification unit 320 generates a sound (e.g., a beep) alerting the user is in the predetermined range and has completed a successful squat.
7. User then holds squat for the preset holding squat time 30 seconds, for example. The system 200 counts down the time via the onboard clock 314. If the user gets out of the squat position before the end of the preset holding squat time, the notification unit 320 generates a beep after a predetermined period of time (e.g., 2-5 seconds) and resets that time to 30 seconds and the user must repeat the holding squat from the beginning.
8. Provided user remains in predetermined range over sensing device 310 for the total preset time, the notification unit 320 will issue a different beep, for example to notify the user that the holding squat is completed, the sensing device 310 also sends a signal to the processor/control unit 312 and the processor/control unit 312 then counts the holding squat and sends a signal to the display 214 to display the number of the holding squat completed.
9. The user rises from the holding squat and repeats.
10. According to another embodiment, if the user chooses to do timed holding squats, the onboard clock 314 tracks how many holding squats the user performs in a predetermined time, as set by the user.
11. The completed time and number of completed holding squats will remain displayed for a predetermined amount of time.

According to other embodiments, the system 100 can further assist users with psychological hindrances potentially get over his or her fear of squats because the bench component 110 will hold a user's weight and optional handrails can be used to assist the user in performance of each squat exercise. If optional handrails are included, they may be collapsible, adjustable, and detachable via an unscrewing operation or other means. According to some embodiments, the handrails may also be weighted (e.g., for approximately 1 to 5 lbs.) and used as one or more weighted bars by the user while performing squat exercises.

According to other embodiments, since the squat exercise system is a portable exercise system, it may also include at least one handle for easy travel and storage. Alternatively, one or more handles may be disposed on one or more sides of the bench component.

The present invention is not limited to performing any particular methods and or any particular settings and can vary, as necessary according to various embodiments of the present invention.

This written description uses examples to disclose the invention including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A squat exercise system comprising:

a bench component configured to function as a landing for a user; and a remote control system configured to control operations performed by the squat exercise system and comprising:

a remote control unit for operating the squat exercise system, and a housing removably attached to an underside of the bench component and comprising operating components of the squat exercise system comprising:

a power supply unit for supplying power, a sensing device configured to sense a body part of the user when within a predetermined distance from the bench component and generate a signal, a processor/control unit configured to receive and process the signal generated by the sensing device in communication therewith, to automatically track, in real-time a count of each successful squat completed and a total count thereof, and a notification unit in communication with the processor/control unit and configured to generate a notification signal indicative of successful completion of a squat.

2. The squat exercise system of claim 1, wherein the remote control unit and the operating components in the housing are communicatively coupled together via a wiring.

3. The squat exercise system of claim 1, wherein the remote control unit is configured to communicate with the operating components wirelessly over a communication network.

4. The squat exercise system of claim 1, wherein the bench component includes an opening at a top portion thereof for displaying the sensing device.

5. The squat exercise system of claim 1 wherein the housing comprising:

an outer body comprising:

a speaker output having a plurality of holes for outputting audio signals to indicate squat status information and a plurality of protruding portions spaced apart along an inner surface thereof for receiving and removably storing the remote control unit thereon when not in use, wherein the remote control unit comprises receiving portions corresponding to the plurality of protruding portions for receiving the protruding portions, when storing thereon.

6. The squat exercise system of claim 1, wherein the remote control unit comprises:

a display configured to display squat exercise information; and a user input device configured to receive squat exercise selections as input by the user, to be performed and to preset settings as desired to initiate performance of a squat exercise.

7. The squat exercise system of claim 6, wherein the squat exercise information comprises at least one of squat height information for user for performing the squat exercise, squat state and different types of squat exercises performed and associated timing information.

8. The squat exercise system of claim 7, wherein the different types of squat exercises comprise single squats, pulsating squats, and holding squats.

9. The squat exercise system of claim 6, wherein the remote control unit further comprises a transmitter/receiver for transmitting/receiving data between the remote control unit and the operating components within the housing.

10. The squat exercises system of claim 6, wherein the display comprises a graphic display module for displaying the squat exercise information and the settings, and wherein the user input device comprises a rotatable push knob for navigating through the display.

11. The squat exercise system of claim 1, wherein the sensing device comprises an ultrasonic distance sensor module configured to sense a body part of the user when within a predetermined distance away from the top portion of the bench component, and wherein the processor/control unit is configured to receive and process signals generated therefrom and data received and transmitted to and from the remote control unit.

12. The squat exercise system of claim 11, wherein the processor/control unit further comprises:

a memory configured to store software instructions for performing sensing via the sensing device and for transmitting data signals to the display, and to store data therein; and an onboard clock configured to count and track a time difference between a current time and a squat exercise start time to determine a duration of the squat exercises being performed for displaying via the display.

13. The squat exercise system of claim 1, wherein the power supply comprises at least one of a rechargeable battery pack or battery receiving power from an external power source, and a connector for receiving a recharging cord to be inserted therein for connecting to the external power source for recharging.

14. A method of performing squat exercises being performed via a squat exercise system, the method comprising:

selecting to preset a squat height on a display via a user input device, wherein a user squats at a desired squat height towards a sensing device, and then pushes the input user device to preset the squat height as desired, wherein the squat exercise system automatically saves the squat height preset by the user;

selecting one type of squat exercise of different types of squat exercises to be performed; performing a squat and sensing via the sensing device activated by a body part of the user located at the squat height a signal indicative of completion of the squat performed;

sending, via the sensing device, the signal to a processor/control unit for processing; and sending a notification signal via a notification unit indicating that the squat was successfully completed; and automatically counting and tracking, in real-time, via an onboard clock of the processor/control unit, a count of each successful squat completed and a total count thereof.

15. The method of claim 14, wherein the different types of squat exercise comprises single squats, pulsating squats, and holding squats.

16. The method of claim 15, further comprising:

presetting, via the user input device, a predetermined time for performing the one of the different types of squat exercises; and timing squats performed via the onboard clock to track how many squats the user performs in the predetermined time, as set by the user.

17. The method of claim 15, wherein performing pulsating squats further comprises:

presetting a number of pulses for each pulsating squat;

performing squats up and down within the squat height;

sensing, the signal indicative of each pulse of the pulsating squat completed, and sending the signal to a processor/control unit for processing, and generating a first notification signal indicative of a successful pulse of the pulsating squat; and upon completion of the number of pulses for each squat, generating a second notification signal different from the first notification signal indicative of a completed pulsating squat; and displaying, via the display, a number of the pulsating squats completed.

18. The method of claim 15, wherein performing a holding squat further comprises:

selecting, via the user input device, an amount of time for holding a squat;

performing the squat and sensing, via the sensing device, the squat being performed, and sending a signal to a processor/control unit for processing; and counting down the amount of time, via the onboard clock and generating a notification signal via a notification unit when the amount of time is completed.

19. The method of claim 14, wherein automatically counting and tracking comprises counting and tracking a time difference between a current time and a squat exercise start time to determine a duration of the squat exercise being performed.

20. A squat exercise system comprising:

a remote control system configured to control operations performed by the squat exercise system and comprising:

a remote control unit for operating the squat exercise system, and a housing to be positioned on a flat surface, and comprising:

a power supply unit for supplying power, a sensing device configured to sense a body part of the user when within a predetermined distance from the housing and generating a signal, a processor/control unit configured to receive and process the signal generated by the sensing device in communication therewith, to automatically track, in real-time a count of each successful squat completed and a total count thereof, and a notification unit in communication with the processor/control unit and configured to to generate a notification signal indicative of successful completion of a squat.

* * * * *